US011896073B2

(12) United States Patent
Hunsucker et al.

(10) Patent No.: US 11,896,073 B2
(45) Date of Patent: Feb. 13, 2024

(54) BELT SYSTEM

(71) Applicant: TEAM NexBelt Operating, Inc., Corona, CA (US)

(72) Inventors: Thomas W. Hunsucker, Rancho Cucamonga, CA (US); Edward R. Rowland, Rancho Cucamonga, CA (US)

(73) Assignee: TEAM NexBelt Operating, Inc., Corona, CA (US)

( * ) Notice: Subject to any disclaimer, the term of this patent is extended or adjusted under 35 U.S.C. 154(b) by 107 days.

(21) Appl. No.: 17/155,627

(22) Filed: Jan. 22, 2021

(65) Prior Publication Data

US 2021/0244119 A1 Aug. 12, 2021

Related U.S. Application Data

(63) Continuation of application No. 16/274,500, filed on Feb. 13, 2019, now Pat. No. 10,897,942, which is a continuation of application No. 15/583,351, filed on May 1, 2017, now Pat. No. 10,208,778.

(60) Provisional application No. 62/358,098, filed on Jul. 4, 2016, provisional application No. 62/330,165, filed on May 1, 2016.

(51) Int. Cl.
*A44B 11/00* (2006.01)
*A41F 9/00* (2006.01)

(52) U.S. Cl.
CPC ..... *A41F 9/002* (2013.01); *Y10T 24/1382* (2015.01); *Y10T 24/4098* (2015.01)

(58) Field of Classification Search
CPC ..... Y10T 24/4098; Y10T 24/1382; A44B 11/005; A44B 11/001; A41F 9/00; A41F 9/002
See application file for complete search history.

(56) References Cited

U.S. PATENT DOCUMENTS

| | | | | |
|---|---|---|---|---|
| 2,836,351 | A * | 5/1958 | Epstein | A44B 11/005 224/163 |
| 2,840,875 | A | 7/1958 | Chambers | |
| 4,562,620 | A | 1/1986 | Oliver | |
| 4,753,377 | A * | 6/1988 | Poluhowich | A44B 11/005 224/232 |
| 6,142,348 | A | 11/2000 | Park | |
| 6,182,388 | B1 | 2/2001 | Patton | |
| 6,886,724 | B2 | 5/2005 | Hung | |
| 7,784,655 | B2 | 8/2010 | Su | |
| D641,661 | S * | 7/2011 | Zhang | D11/231 |
| 8,689,364 | B2 * | 4/2014 | Rowland | A44B 11/12 2/311 |
| 9,351,526 | B1 * | 5/2016 | Taylor | A44B 11/12 |
| 2004/0099702 | A1 | 5/2004 | Conner | |
| 2007/0084892 | A1 | 4/2007 | Korlath | |
| 2008/0120813 | A1 * | 5/2008 | Su | A44B 11/005 24/163 K |
| 2010/0132164 | A1 | 6/2010 | Su | |

(Continued)

*Primary Examiner* — Robert Sandy
*Assistant Examiner* — Michael S Lee
(74) *Attorney, Agent, or Firm* — Foley & Lardner LLP

(57) ABSTRACT

A belt clip is adapted for storing a belt. The belt clip includes a first clip member and a second clip member that mechanically and removably attaches to the first clip member. The first clip member and the second clip member collectively form an elongated tunnel through which a belt can be looped.

11 Claims, 23 Drawing Sheets

(56) References Cited

U.S. PATENT DOCUMENTS

| | | | | |
|---|---|---|---|---|
| 2011/0167597 | A1 | 7/2011 | Su | |
| 2015/0113770 | A1* | 4/2015 | Laatz ..... | A47G 25/74<br>24/191 |

* cited by examiner

BELT SYSTEM

CROSS REFERENCE TO RELATED APPLICATIONS

This application is a continuation of U.S. application Ser. No. 16/274,500 entitled "Belt System" and filed on Feb. 13, 2019, issuing on Jan. 26, 2021 as U.S. Pat. No. 10,897,942, which is a continuation of U.S. application Ser. No. 15/583,351 entitled "Belt System" and filed on May 1, 2017, now U.S. Pat. No. 10,208,778, and claims priority to (1) U.S. Provisional Patent Application Ser. No. 62/330,165 entitled "Belt System" and filed on May 1, 2016; and (2) U.S. Provisional Patent Application Ser. No. 62/358,098 entitled "Belt System" and filed on Jul. 4, 2016. The disclosures of which are hereby incorporated by reference in their entirety.

BACKGROUND

Conventional belt buckles or belt adjustment systems are limited in their ability to conform to a particular user's waist size. Belt adjustment systems conventionally secure a belt about a user's waist by relying on a series of spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size, but is generally limited by the minimal material that must remain between the holes.

Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

Regardless of the type of belt, it can be difficult to store a belt and the compact shape due to the long and flexible nature of the belt. As a result, in order to store a belt such as in luggage or when being displayed in a store, many users simply cost the belt in the luggage or place the belt on an extended state on a table or hanging from a hook. This can consume a large amount of space and can be inefficient from a storage standpoint.

SUMMARY

In view of the foregoing, there is a need for methods and systems that can be used to efficiently store and contain a belt in a manner that is time efficient and efficient from a space-saving standpoint. There is also a need for methods and systems related to belt and belt adjustment systems.

In one aspect, there is disclosed a belt clip for storing a belt, comprising a first clip member and a second clip member that mechanically and removably attaches to the first clip member, wherein the first clip member and the second clip member collectively form an elongated tunnel through which a belt can be looped.

Other features and advantages should be apparent from the following description of various embodiments, which illustrate, by way of example, the principles of the claimed subject matter.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

Figure 1:
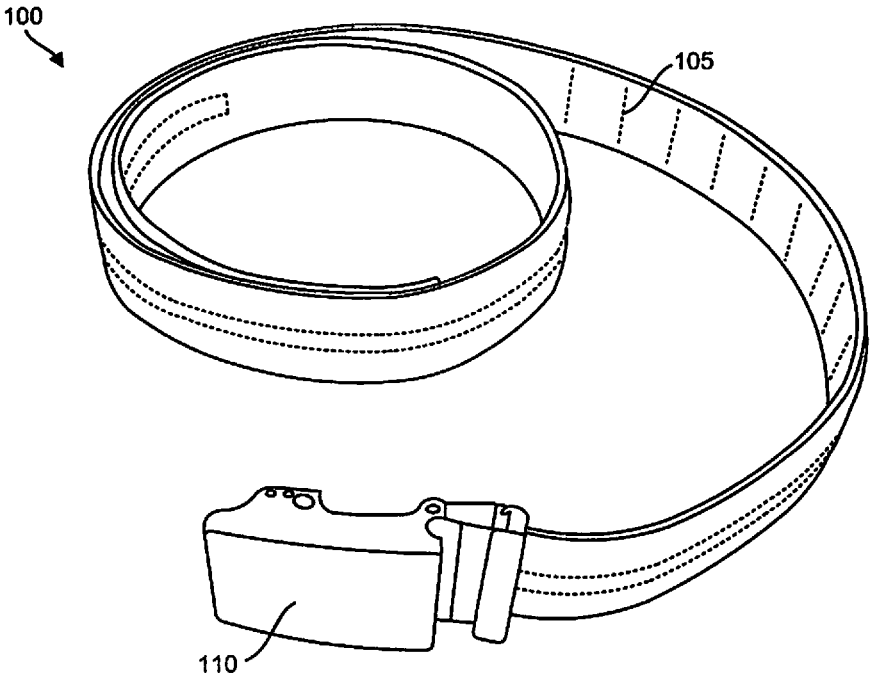
FIG. 1 shows a schematic view of an embodiment of a belt system.

FIG. 1 shows a perspective view of an embodiment of a belt system 100 that may be worn with a pair of pants, shorts, trousers, skirts or other articles of clothing. The system 100 can also be used with other items such as watch straps, purse straps, guitar straps or animal collars or other articles that may include a buckle system that is adjusted for size or where a number of size variations would be desirable. Some figures include exemplary numerical dimensions. It should be appreciated that the dimensions are for example only and are not intended to be limiting. The belt buckle system can be configured with dimensions outside of the ranges and values shown.

The belt system 100 includes an elongated belt 105 and a buckle 110 disposed on a first end of the belt 105. The buckle 110 is removably attached to the belt such as by using a clamp on the buckle 110. The belt buckle 110 is a pinless buckle in that it does not use a pin to secure itself to the belt 105 when the belt is looped around a user's waist. The belt buckle 105 has a front face that faces away from a user or a user's torso when the belt is worn around the user's waist.

That is, the belt buckle 105 sits flat against the user's waist or torso such that the buckle will be positioned over the region of the user's pants where a button is typically located on the user's pants.

Figure 2:
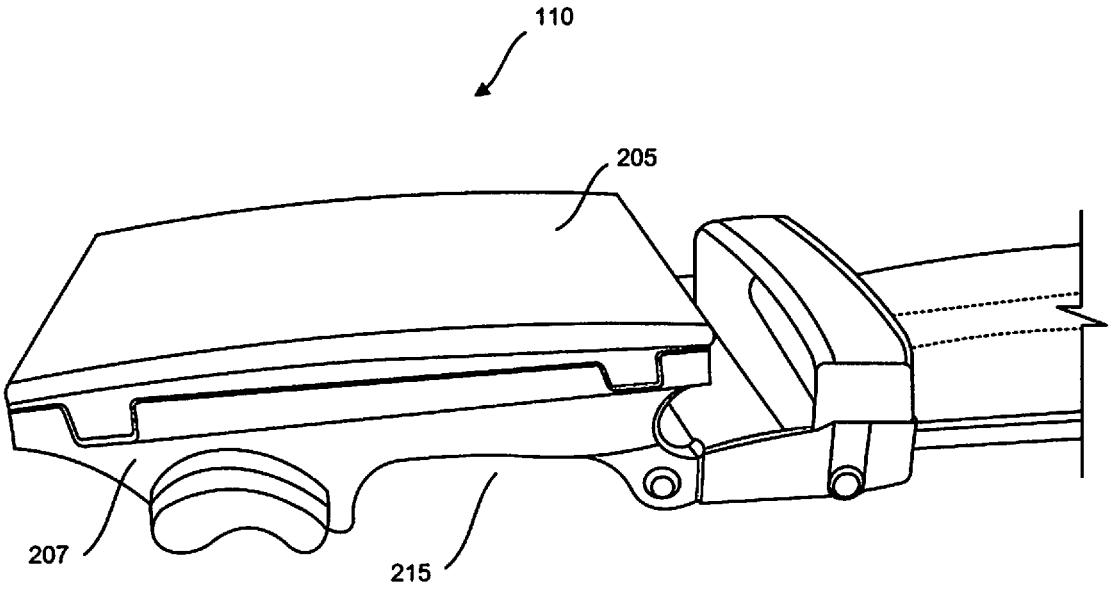
FIG. 2 shows a perspective, side view of a belt buckle of the belt system.
Figure 3:
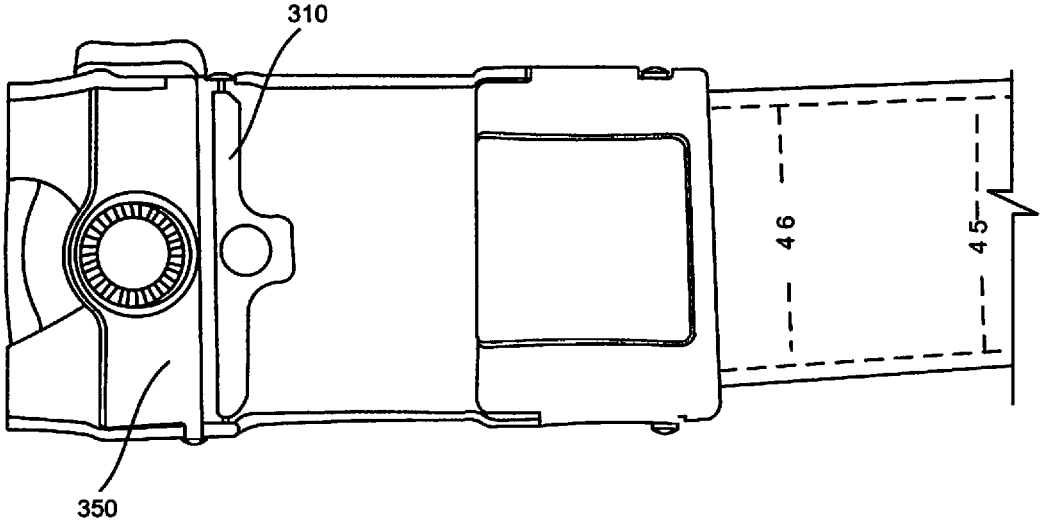
FIG. 3 shows a bottom view of the belt buckle.
Figure 4:
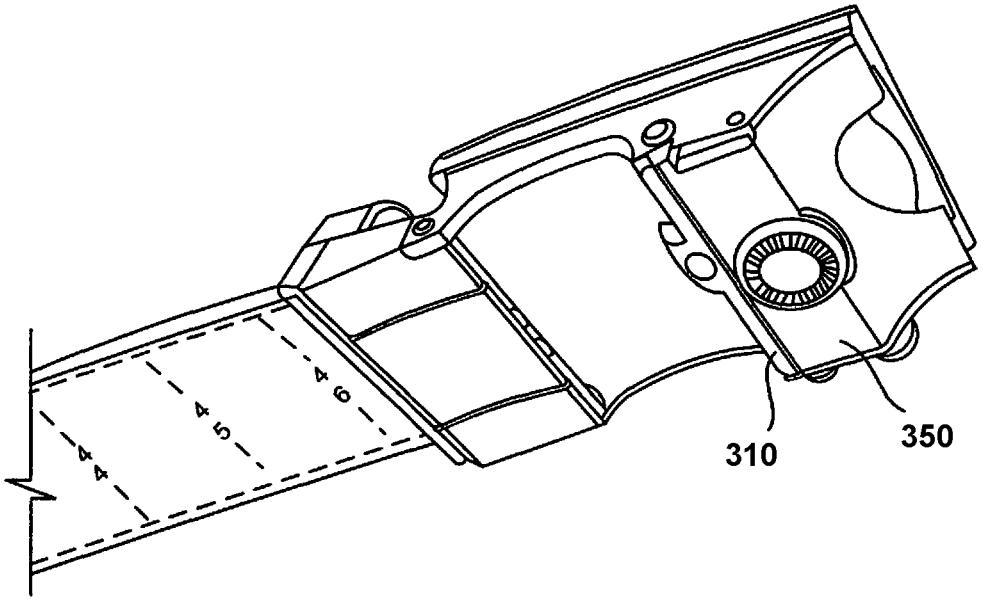
FIG. 4 shows a bottom view of the belt buckle.

FIG. 2 shows a perspective, side view of the belt buckle 110. FIGS. 3 and 4 show bottom views of the belt buckle 110. The belt buckle 110 has a front face that is formed by a door 205 or other movable portion. The door 205 is movable relative to a body 207 of the belt buckle such that the door 205 can be opened (such as in a pivoting manner) relative to the body to expose an internal chamber, as described in more detail below.

With reference to FIGS. 3 and 4, the buckle 110 has a bridge 305 that forms or at least partially defines an opening through which the opposite end of the belt can be threaded when worn by a user. A movable latch 310 or other pinless member is configures to move towards and engage with a portion of the opposite end region of the belt when the opposite region is positioned through the opening formed by the bridge 305 for securing the belt to the buckle in a desired position. In an embodiment, the latch 310 secures to a tooth or other engagement portion formed within a row of engagement portions on the belt. The latch 310 can be biased toward a latching engagement with the belt such as by using a biasing member, which can be, for example, a magnet, a spring, or other device.

With reference to the side view of FIG. 2, the body 207 of the buckle 110 is shaped such that a cavity or cut out 215 is formed on the side of the body 207. The cut out 215 is such that a region of the body 207 is thinner relative to an adjacent region, with the region being thinner along a dimension or direction normal to a wearer's body when the belt is worn around the wearer's waist. That is, the direction is a direction along the line of sight of a person that is facing the wearer and looking toward the front side of the wearer. In this manner, the body of the buckle is so dimensioned so that the wearer's pants button does not contribute to or cause the belt buckle to protrude any further outward from the wearer's pants if the wearer's pants did not have a button in the region of the buckle when the buckle is worn. The cut out is so dimensioned relative to a wearer's pant button so that the pant button fits within the cut out.

The cut out 215 is sized and shaped to form a gap in the body of the buckle in which the wearer's pants button can be positioned when the belt is worn. In this manner, the buckle can be positioned atop the button without the button contributing to the overall size of the buckle or pushing the buckle outward away from the user's body. The button therefore does not interfere with the belt buckle and does not result in the buckle being pushed outward from the user's body when the belt is worn around the waist. FIG. 2 shows one side view of the belt buckle. It should be appreciated that the opposite side view of the belt buckle also has a cutout 215 similar to the cutout 215 shown in FIG. 2. The cut out 215 is located along the length of the belt buckle with the length being the longitudinal direction of the belt member. The cutout 215 extends along only a portion of the entire length of the belt buckle such that the belt buckle has a thickness that is greater where the cavity or cutout 215 is not located relative to whether cavity or cutout 215 is located.

Figure 5:
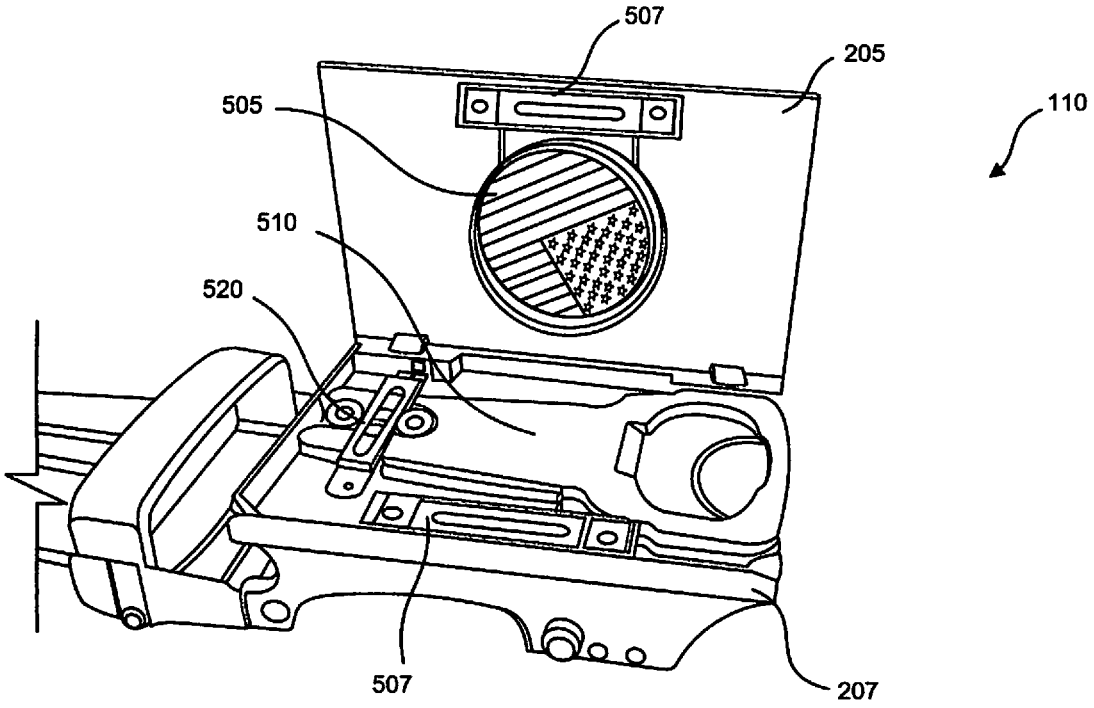
FIG. 5 shows the belt buckle with a door in an open state such that an internal chamber is exposed.

FIG. 5 shows the belt buckle 110 with the door 205 in an open state such that the internal chamber is exposed. The internal chamber is exposed and accessible when the door 205 is open as shown in FIG. 5. When the door 205 is closed (as in FIGS. 1 and 2 for example), the door 205 is positioned relative to the belt buckle body such that the internal chamber is covered and hidden by the door 205. In this manner, the internal chamber is collectively formed by the body of the belt buckle and the door 205 when the door is closed.

The door 205 may move relative to the body of the belt buckle in a variety of manners including in a pivoting or rotating manner. In this regard, the one or more hinges attach the door 205 to the belt buckle body. Other types of movement are possible such as a sliding movement between the door 205 and the body.

Figure 6:
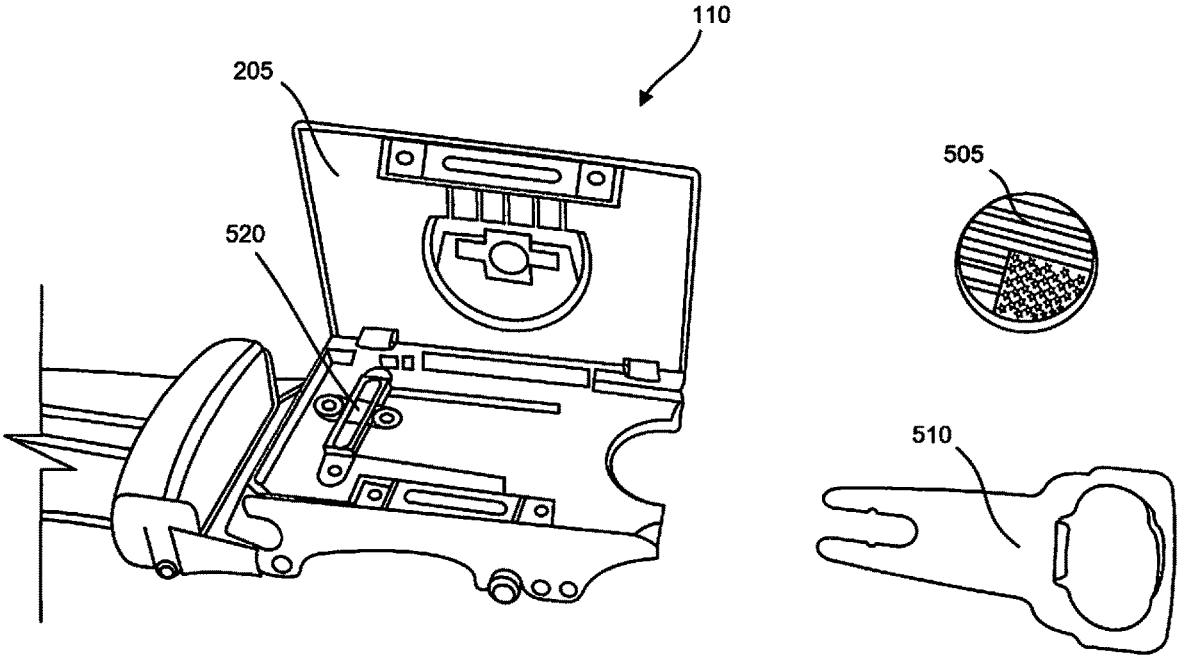
FIG. 6 shows the belt buckle with a door in an open state such that an internal chamber is exposed and components removed from the internal chamber.

As shown in FIG. 5, the internal chamber is sized and shaped to contain one or more items. The items are covered or hidden when the door 205 is closed. In the illustrated embodiment, the items include a ball marker 505, which is disc-like member. The ball marker is positioned within a complementary-shaped indentation on the inner side of the door 205 and can be secured thereto such as by a magnet for example. The items also include a golf divot repair tool 510 that sits on the body 207 in the internal cavity. The divot repair tool 510 is secured within the cavity by a crossing member 520 that fits over the divot repair tool and secures it therein such as in a press fit manner. Other retaining elements can also be used such as one or more magnets to secure the divot repair tool 510 or other items in the chamber. FIG. 6 shows the buckle 110 with the ball marker 505 and divot repair tool 510 removed from the internal chamber.

With reference to FIG. 5, the door 205 can be secure in the closed position such as by using one or more magnetic engagements 507 between the body 207 of the buckle and the door 205. In this regard, a magnet may secure in the door 205 and/or the body 207 so that they contact one another and secure the door in the closed position when the door is closed. The magnet(s) may be positioned and secured beneath a securing element, such as a bridge structure. Other ways of securing the door in the closed position can be used.

Figure 7:
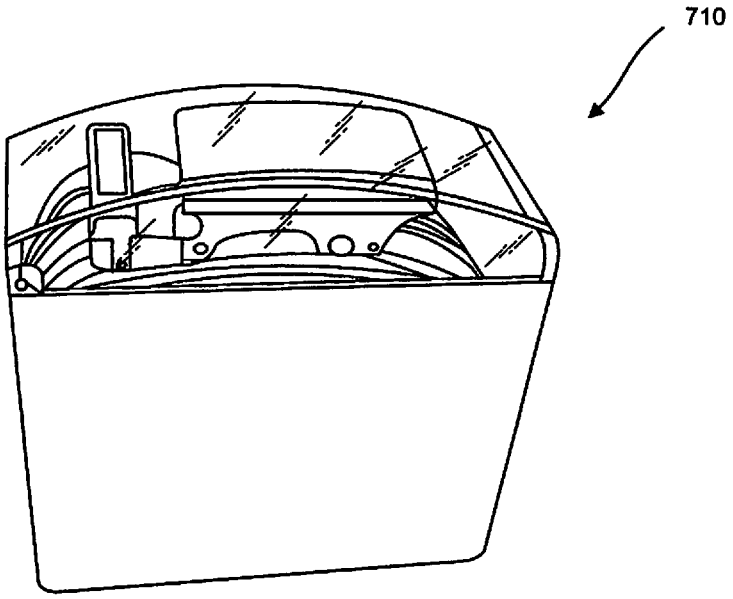
FIG. 7 shows an example of a belt container in which the belt can be stored.
Figure 8:
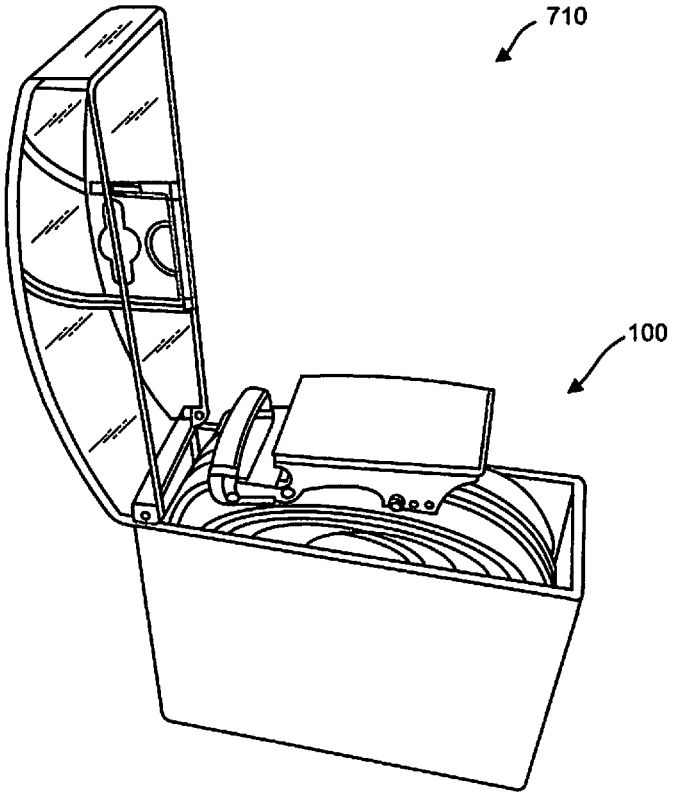
FIG. 8 shows the belt container in an open state.

In an embodiment, the belt 100 can be stored in a belt container 710, as shown in FIGS. 7 and 8. The belt container 710 is sized and shaped to define an interior cavity that can contain the belt 100 in a rolled state. The interior cavity of the container 710 is sized so that the belt 100 is snugly stored within the container 710 such that the belt will not rattle or move when the container is closed. In this regard, the container 710 has a door that can be opened (as shown in FIG. 8) and closed (as shown in FIG. 7) to provide access to the belt.

Figure 9:
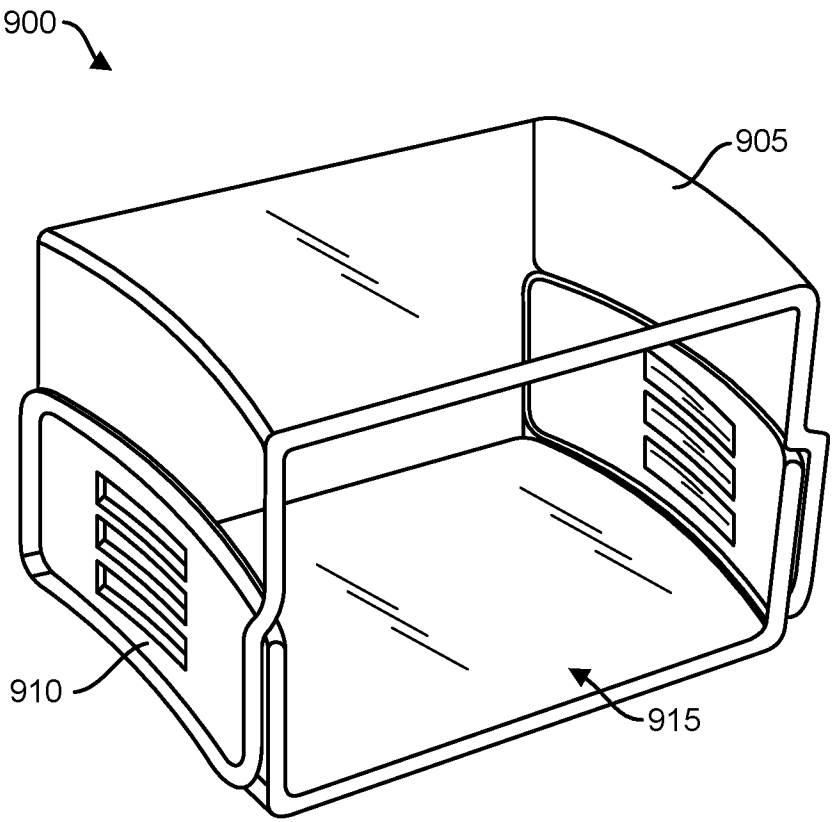
FIG. 9 shows a perspective view of a clip system that can be used to store a belt in a loop configuration.

FIG. 9 shows a perspective view of a clip system 900 that can be used to store and contain an elongated belt in a looped state or configuration, as described in more detail below. The clip system 900 is a structure that forms a partially enclosed passageway with an opening 915 on either end through which the length of the belt member can be repeatedly looped so as to constrain the belt member in a loop configuration. In the illustrated embodiment, the clip system 900 is formed of a first member 905 (first clip member 905) and a second member 910 (second clip member 910) that are attached to one another to collectively form the opening 915 through which a belt can be looped. In an example embodiment, each of the first member 905 and the second member 910 are made of a rigid material, such as plastic. The first member 905 the second member 910 can also be made using an injection mold and each can be a monolithic body. It should be appreciated that the first member and the second member can also be made of other materials that are rigid or flexible.

Figure 10:
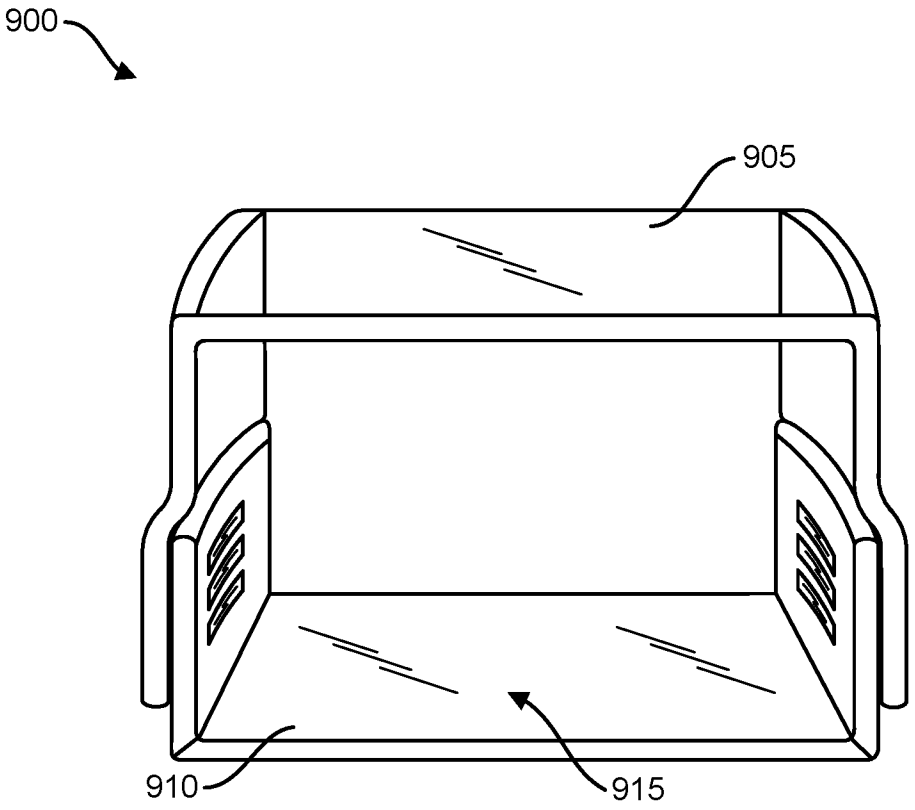
FIG. 10 shows a front view of the clip system.

FIG. 10 shows a front view of the clip system and shows a particular shape of the opening 915. The opening 915 is an elongated tunnel with the outer periphery walls of the tunnel being formed by the clip system 900, and in particular by the first member 905 and the second member 910. In the illustrated embodiment, the opening has a substantially rectangular shape when viewed as shown in FIG. 10 although it should be appreciated that the size and shape of the opening, as well as the size and shape of the clip system, can be varied to accommodate belts of various sizes and shapes. Thus, the shape is not limited to the shape shown in the figures.

Figure 11:
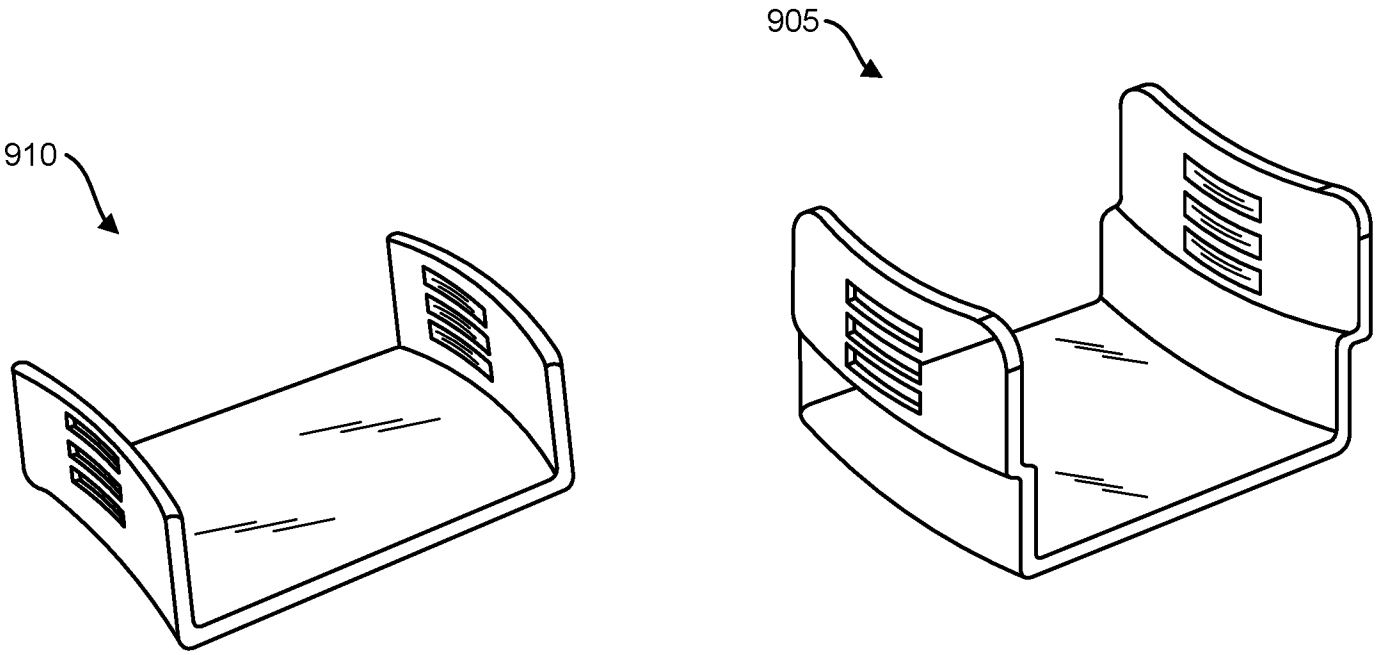
FIG. 11 shows a perspective view of a first member and a second member of the clip system.

FIG. 11 shows the 900 in a disassembled state with the first member 905 detached from the second member 910. Each of the first and second members 905 and 910 is a U-shaped structure. The legs of the U-shaped structure of each of the first and second member are sized and shaped so that the legs of the first member can be juxtaposed with the legs of the second member to form the opening 915 when the system is in the assembled state. That is, the first member 905 is sized such that the legs of the second member 910 can nest or seat within the first member 905 with the legs of each member juxtaposed with one another so as to collectively form the passageway and opening. In other words, one of the peripheral legs of the first member 905 is positioned immediately adjacent a corresponding leg of the second member 910, while the other of the peripheral legs of the first member 905 is positioned immediately adjacent a corresponding other leg of the second member 910. In this manner, the first and second members collectively form the elongated tunnel with the tunnel being positioned between the legs.

Figure 12:
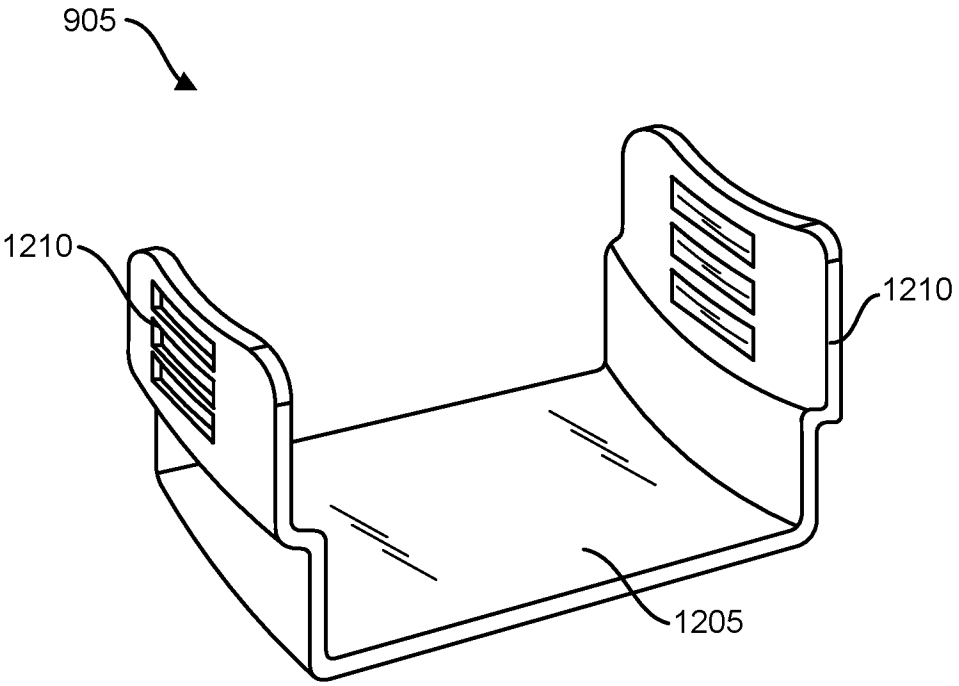
FIG. 12 shows a perspective view of the first member of the clip system.

FIG. 12 shows a perspective view of the first member 905. The first member has a base portion 1205 with an inner surface that forms the upper outer periphery of the passage, tunnel, or opening 915. The inner surface (i.e., the surface that defines the elongated tunnel) of the base portion forms a curved plane with a curvature that matches a curvature of the belt when the belt is in a looped state and contained in the clip. That is, one of the inner surfaces can be concave, while the other of the inner surfaces that forms the passage or tunnel is convex. In this manner, the curvature of the looped belt can fit snug and flush against the concave and convex surfaces of the tunnel or passage.

A pair of legs 1210 extend outwardly from each of the transverse, outer edges of the base portion 1205. The legs 1210 each have inner surfaces that form the side outer peripheries of the passage or opening 915. In addition, each of the legs 1210 has a coupler that mechanically couples to a corresponding coupler on the legs of the second member 910. For example, the legs 1210 can have a series of openings or notches that are spaced apart in series and that are positioned along the length of the legs 1210. The openings are sized and shaped to receive corresponding protrusions on legs of the second member 910 so as to permit the second member 910 to be adjustably locked in place relative to the first member.

Figure 13:
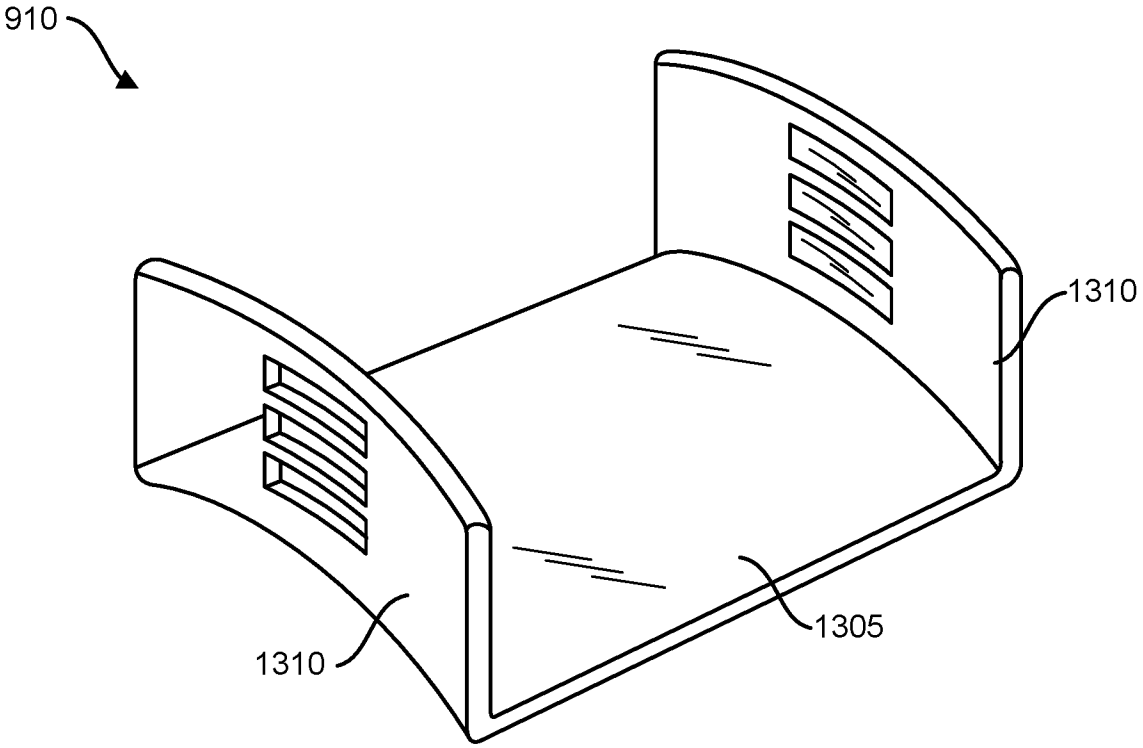
FIG. 13 shows a perspective view of the second member of the clip system.

FIG. 13 shows a perspective view of the second member 910. The second member also has a base portion 1305 with an inner surface that forms the lower outer periphery of the passage or opening number 915. The inner surface of the base portion 1305 forms a curved plane with a curvature that matches a curvature of the belt when the belt is in a looped state and contained in the clip.

A pair of legs 1310 extend outwardly from each of the transverse, outer edges of the base portion 1305. The legs 1310 each have an inner surface that forms the side, outer periphery of the passage or opening 915. In addition, each of the legs 1310 has a coupler that mechanically couples to the corresponding coupler on the legs 1210 of the first member 95. In the illustrated embodiment, the legs 1310 have a series of protrusions that complement the series of openings on the legs 1210 of the first member 905. As mentioned, protrusions are sized and shaped to be inserted into and made with the openings on the legs of the first member. This permits the first and second members to be adjustably and lockingly coupled to one another and fixed in place relative to one another so as to form the opening 915. The position of the first member relative to the second member can be adjusted by selectively positing the couplers of the first member relative to the couplers of the second member. For example, the legs can adjust and lock relative to one another using a ratchet mechanism positioned on the legs.

Figure 14A:
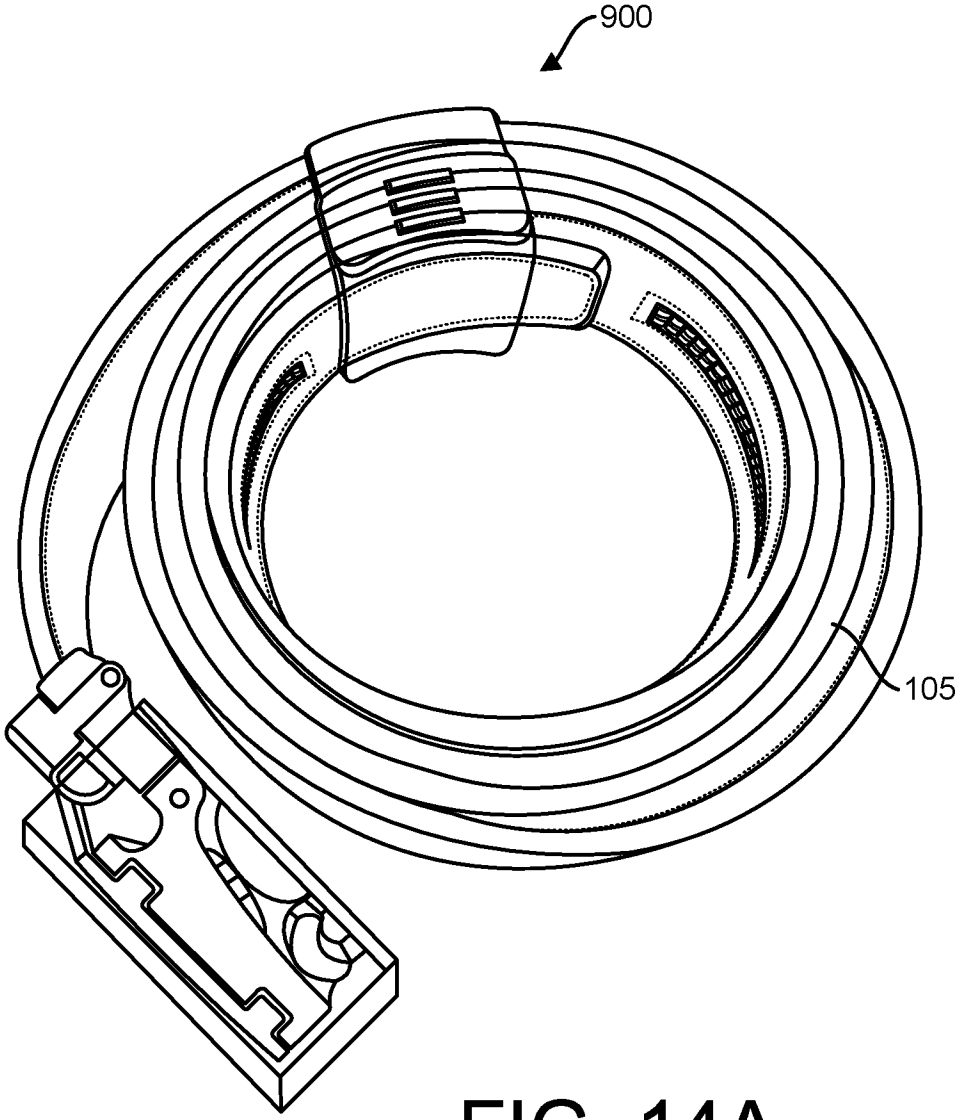
FIGS. 14A and 14B shows the clip system mounted on the belt member.
Figure 14B:
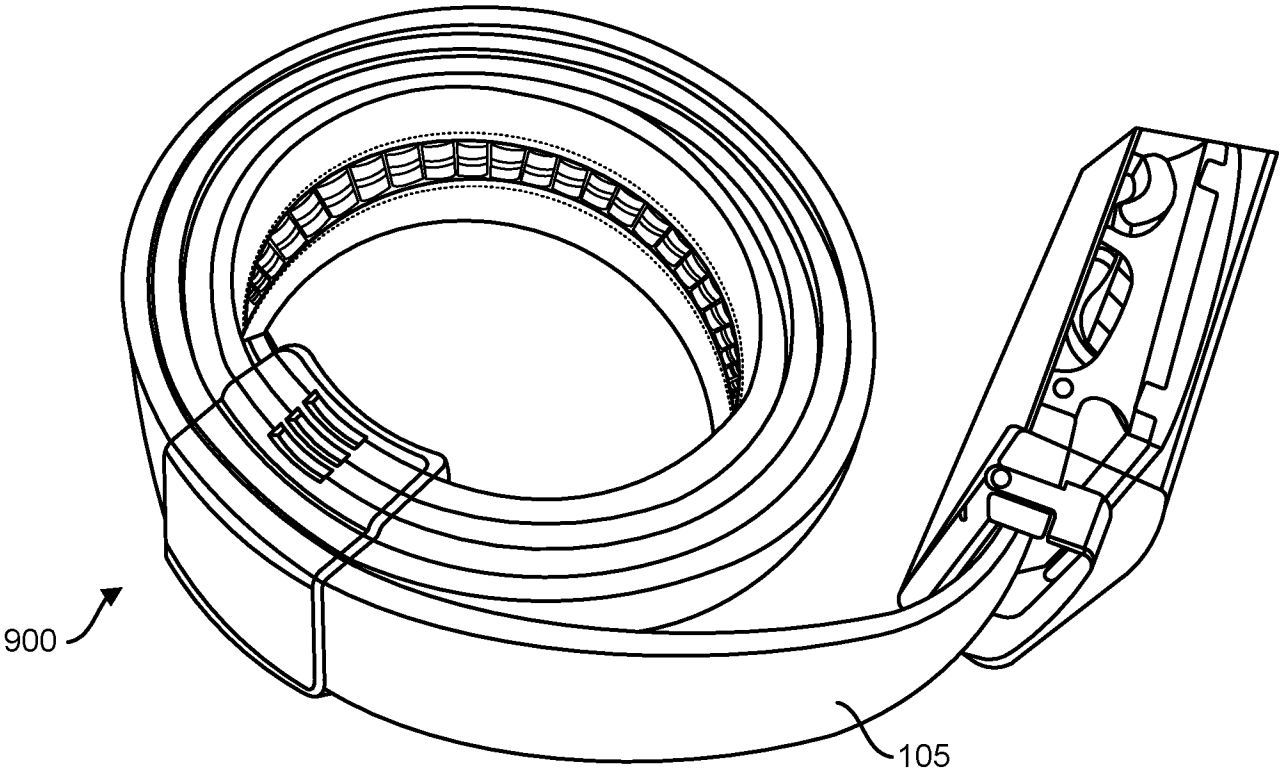

FIGS. 14A and 14B shows the clip system 900 mounted on the belt member. Note that the belt member has been looped multiple times through the opening 915 in a manner such that the clip system 900 retains the belt member 100 in the looped configuration. The base portions of the first and second members form curved surfaces that are positioned against the surface of the belt. The curved surfaces have a curvature such that the surface of the belt is flush against the curved surfaces of the belt when looped.

The clip system 900 can be mechanically actuated by moving the ratchets of first member relative to the openings in second member to change the size of the opening 915 so that the looped belt fits snug within the opening 915. In this manner, the clip system 900 retains the belt member in the looped state. When desired, the user can move the first member relative to the second member to either increase the size of the opening or to entirely remove the first member relative to the second member and release the belt from the looped state.

In use, a user roles the belt into a loop, such as shown in FIG. 14A. The user then positions one of the first member or the second member so that the looped belt is positioned within the legs of the first or second member. The user then positions the other of the first or second member adjacent the member that was positioned over the looped belt and locks the first and second members relative to one another using the ratchet mechanism therebetween. The user can adjust the size of the tunnel so that the looped belt fits snug within the tunnel. As mentioned, the inner surfaces of the first and second member are concave and convex so that the looped belt is positioned flush with the inner surfaces.

Figure 15:
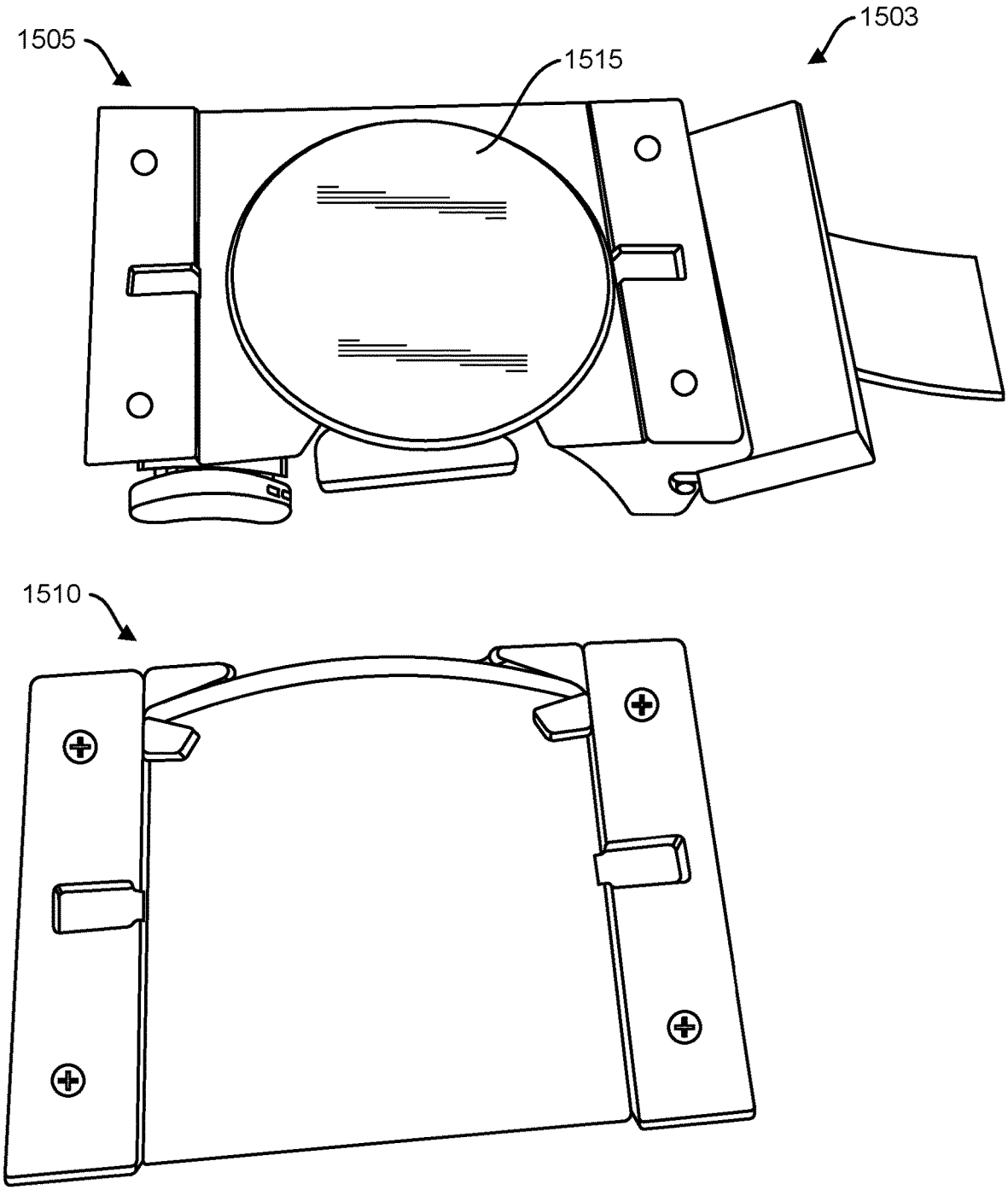
FIG. 15 shows an exploded view of an alternate embodiment of a buckle that contains a ball marker.

FIG. 15 shows an alternate embodiment of a buckle 1503 that also has a mechanism for interacting with a belt having no holes. The buckle may be mechanically similar or identical to any other embodiment described herein with respect to the manner in which it interacts with the belt member. The buckle includes a first buckle portion 1505 that attaches to a second buckle portion 1510 to collectively form the buckle. A ball marker 1515 is a planar member, such as a round, disc-shaped member, that is sized and shaped to fit inside an internal cavity inside the buckle.

Figure 16:
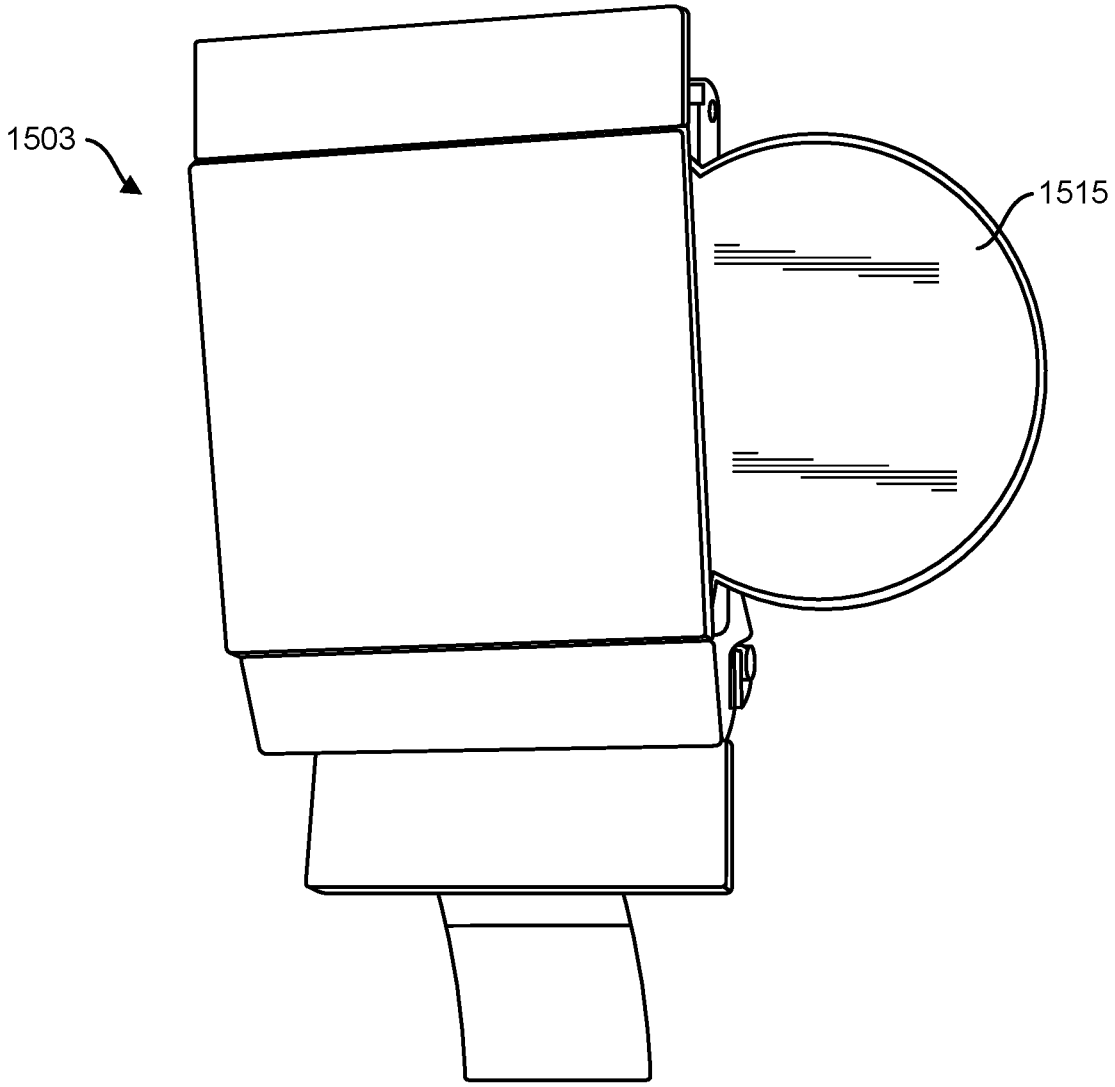
FIG. 16 shows how the ball marker interacts with the buckle.

With reference to FIG. 16, the ball marker 1515 slidably inserts into the buckle 1503. The buckle 1503 includes a slot 1705 (FIG. 17) that is sized and shaped to slidably receive the ball marker 1515. The slot communicates with the internal cavity of the buckle 1503. The ball marker slides into the buckle 1503 in a direction that is parallel to a plane defined by the front face (or back face) of the ball marker 1515. In this manner, the ball marker is inserted into the buckle 1503 by a user grasping the ball marker, aligning it with the slot, and then sliding the ball marker into the slot. The buckle 1503 may include an internal mechanism, such as a clip, that interacts with the ball marker and retains the ball marker inside the buckle once it is inserted into the buckle. The buckle may also include a spring mechanism that ejects the ball marker when actuated by a user.

Figure 17:
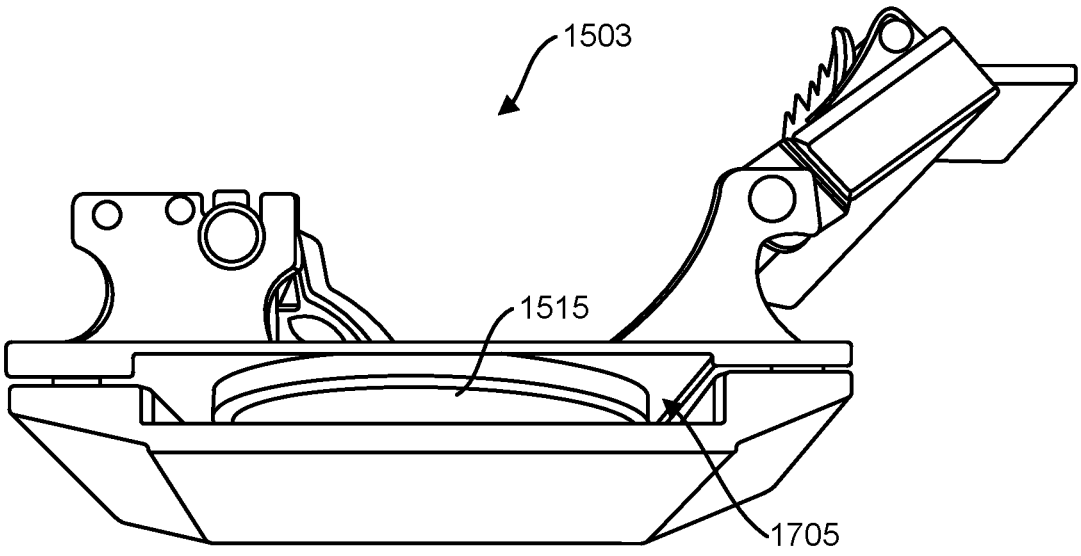
FIG. 17 shows the ball marker inside the buckle.

FIG. 17 shows a side view of the buckle 1503 with the ball marker 1515 positioned inside the buckle. The ball marker 1515 has been inserted into the inner cavity of the buckle 1503 via the slot 1705.

Figure 18:
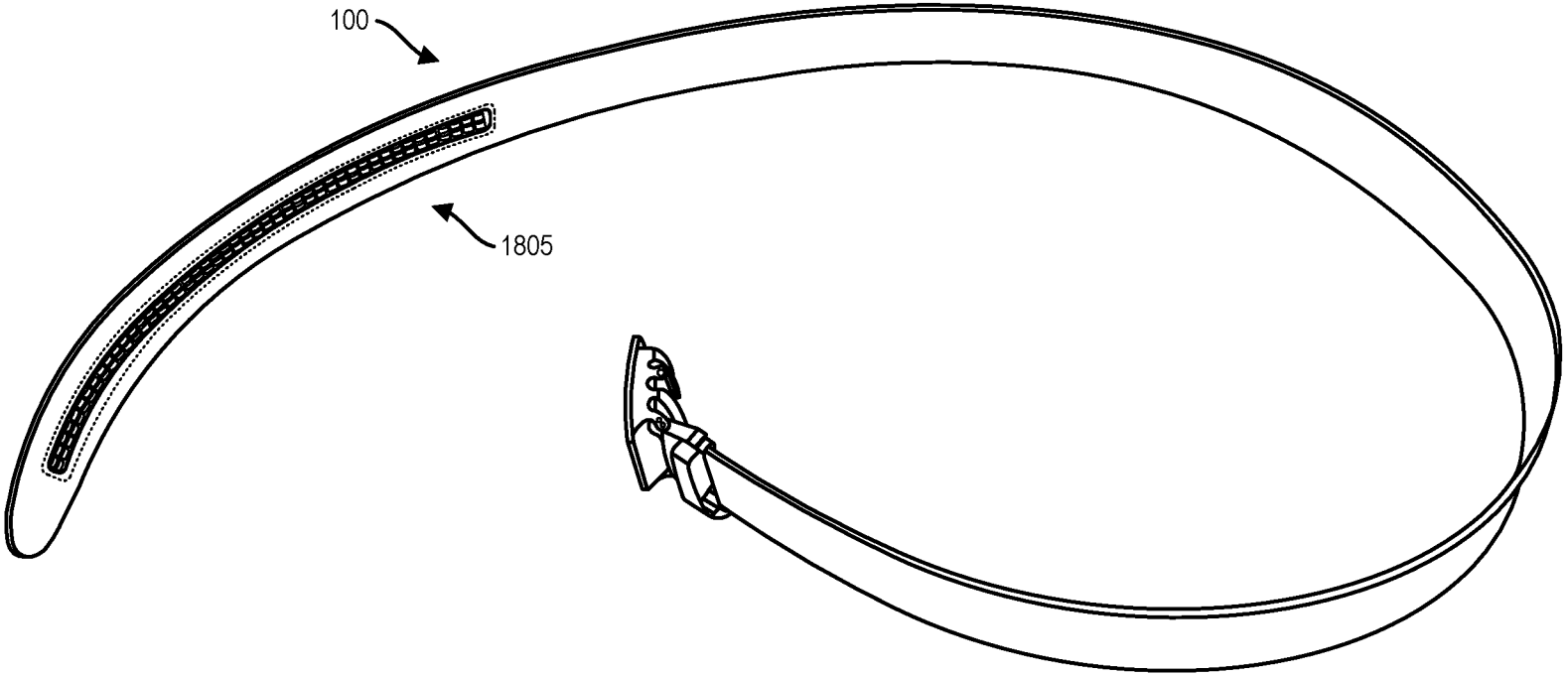
FIG. 18 shows another embodiment of a belt.
Figure 19:
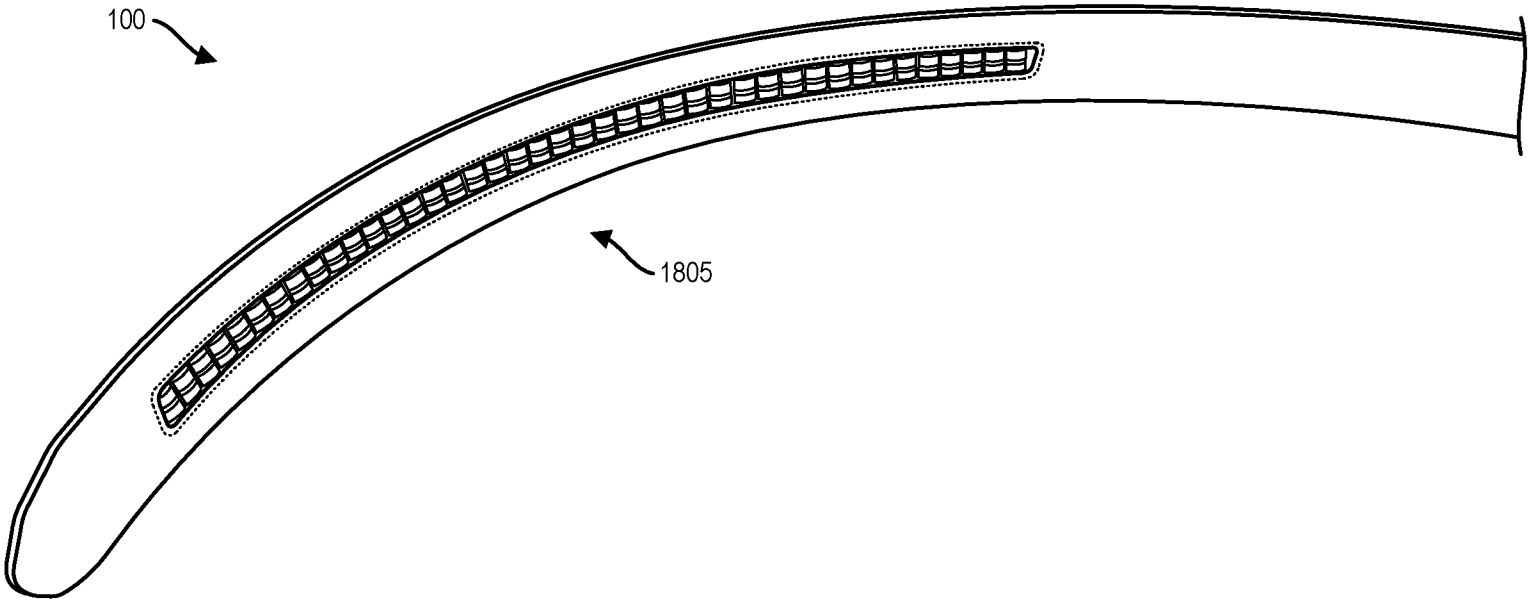
FIG. 19 shows an enlarged view of a portion of the belt.

FIG. 18 shows a belt 100 that has an insert member 1805 positioned inside the belt along at least a portion of the length of the belt. The insert member 1805 has a series of teeth or ratchets that are configured to engage with a corresponding pawl on the buckle of the belt 100. FIG. 19 shows an enlarged view of the insert member 1805. As shown, the teeth or ratchets are positioned in series along the length or a portion of the length of the belt 100. The teeth or ratchets form inclined surfaces that are configured to engage a pawl on the buckle of the belt 100. The insert member 1805 is positioned within the belt or within at least a portion of the belt 100 as described further below.

Figure 20:
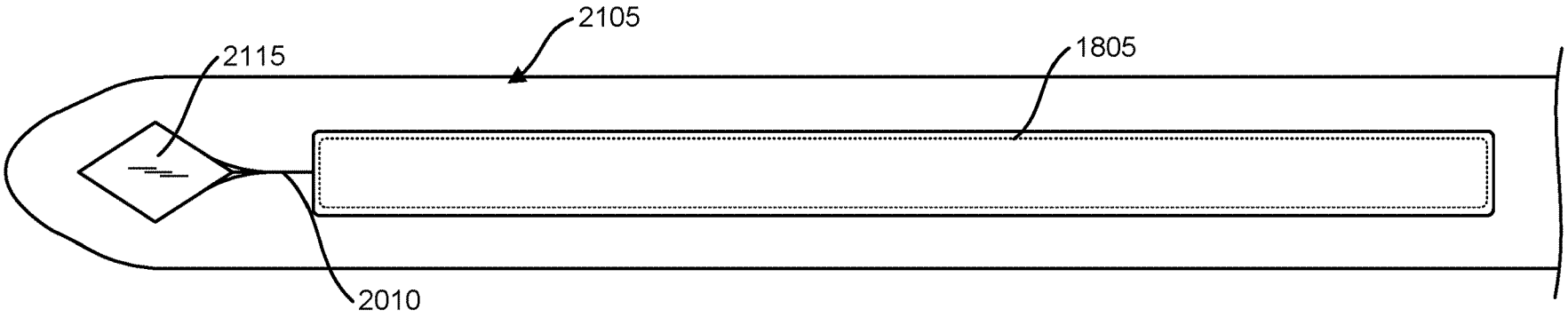
FIG. 20 shows an insert portion of the belt.

FIG. 20 shows an enlarged view of a backside of the insert member 1805. The insert member 1805 is an elongated, substantially planar and that is made of a flexible material, such as plastic polyurethane. The insert member 1805 is at least partially wrap or layered within an outer member 2105 that is formed of a flexible material such as a fabric. The outer member 2105 is wrap around the insert member 1805 such that the outer member 2105 forms a pair of hems that are so together at a seam 2010. The insert member 1805 can also be sewed or otherwise threaded to the outer member 2105 using thread or any filament.

Figure 21:
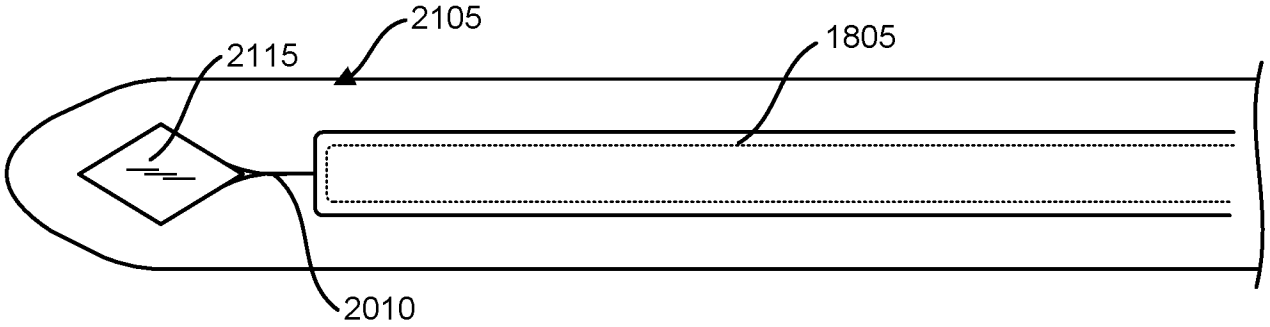
FIG. 21 shows an enlarged view of the insert portion.

FIG. 21 shows an enlarged view of the insert member 1805 positioned within or layered within the outer member 2105.

Figure 22:
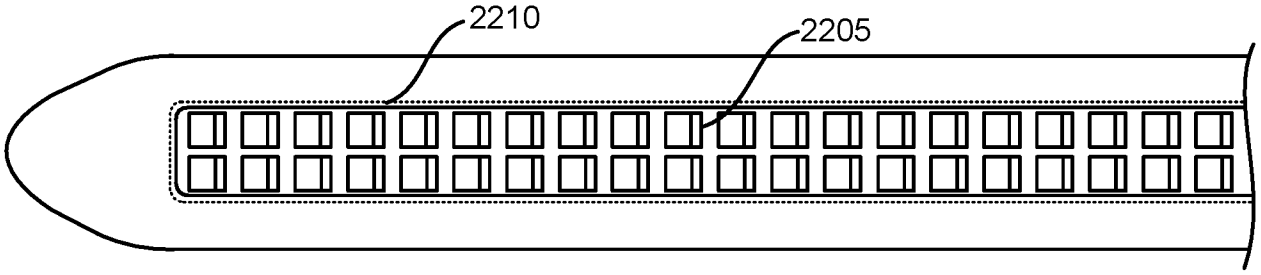
FIG. 22 shows another enlarged view of the insert portion.

FIG. 22 shows an enlarged view of the front side of the insert member 1805. An aperture 2210 is formed on the front side of the outer member 2105. At least a portion of the insert member 1805 protrudes or extends through the aperture 2210 wherein the teeth 2205 of the insert member 1805 protrudes through the aperture 2210. In this manner, the outer member 2105 wraps at least partially around the insert member 1805 with the aperture 2210 aligning with the series of teeth 2205 of the insert member 1805 such that the teeth 2205 protrudes through the aperture. In use, the structure formed by the collective outer member 2105 wrapped around the insert member can be used as a belt or it can be attached to a correspondingly sized leather belt and attached thereto such as by using thread, glue, or any other attachment number four attachment.

In an embodiment, the configuration of the belt system, such as the configuration of the belt buckle and the elongated belt 105 can be used for belts that are not clothing belts. For example, in an embodiment, the belt system is part of a belt that is used to secure a bag, pouch, or other structure to a vehicle, such as a motorcycle. In an embodiment, the belt system is part of a strap for a motorcycle bag.

Although embodiments of various methods and devices are described herein in detail with reference to certain versions, it should be appreciated that other versions, embodiments, methods of use, and combinations thereof are also possible. Therefore, the spirit and scope of the appended claims should not be limited to the description of the embodiments contained herein.

The invention claimed is:

1. A belt system, comprising:

an elongate belt member comprising a first end, a second end and an inner surface near the second end, wherein the inner surface has a series of teeth;

a buckle system removably attached on a first end of the belt member, including a ratchet assembly that engages the series of teeth on the belt member, the buckle including a clamp mechanism that clamps onto the first end of the belt member to secure the belt member to the buckle system, and wherein the buckle system further includes a slot that communicates with an internal cavity of the buckle system, the slot being formed by a space between a front door and a rear structure of the buckle system; and a divot repair tool that fits through the slot into the internal cavity and at least a portion of the divot repair tool is secured within the internal cavity by a crossing member, wherein at least a portion of the crossing member is configured to extend over the divot repair tool.

2. The belt system as in claim 1, wherein the front door is attached to the rear structure on which the clamp mechanism is mounted, wherein the front door on the belt buckle opens and closes to reveal the internal cavity and wherein the door encloses the divot repair tool within the internal cavity when the door is closed.

3. The belt system as in claim 1, wherein the internal cavity is sized and shaped to contain the divot repair tool.

4. The belt system as in claim 1, wherein the front door encloses the divot repair tool between the front door and the rear structure of the buckle system when the front door is in a closed position.

5. The belt system according to claim 1, wherein the crossing member is configured to retain the divot repair tool within the internal cavity.

6. The belt system according to claim 5, wherein the crossing member positions the divot repair tool against the inner cavity wall.

7. A belt system, comprising:

a belt member having a first end, a second end, and an inner surface, wherein a portion of the inner surface positioned about the second end has a series of teeth;

a buckle system, the buckle system including a ratchet assembly configured to engage the series of teeth on the belt member, a clamp mechanism configured to clamp onto the first end of the belt member to removably engage the belt member with the buckle system, an internal cavity defined by a space between a front door and an inner cavity wall, and a crossing member positioned within the internal cavity; and a divot repair tool that is sized to fit within the internal cavity with a portion of the divot repair tool positioned between the crossing member and the inner cavity wall in a pressed fit manner.

8. The belt system according to claim 7, wherein the front door is movable between an open position and a closed position, wherein when the front door is in the open position, the internal cavity is accessible and when the front door is in the closed position, the internal cavity is covered by the front door.

9. A belt system, comprising:

an elongate belt member comprising a first end, a second end and an inner surface near the second end, wherein the inner surface has a series of teeth;

a buckle system removably attached on a first end of the belt member, including a ratchet assembly that engages the series of teeth on the belt member, the buckle including a clamp mechanism that clamps onto the first end of the belt member to secure the belt member to the buckle system, and wherein the buckle system further includes a slot that communicates with an internal cavity of the buckle system, the slot being formed by a space between a front door and a rear structure of the buckle system; and a crossing member extending across the cavity such that a gap is formed between a portion of the crossing member and the rear structure of the buckle system, the crossing member configured to secure a divot repair tool within the slot in a pressed fit manner.

10. The belt system according to claim 9, wherein the front door is movable from an open position to a closed position.

11. The belt system according to claim 9, wherein the crossing member is configured to secure the divot repair tool between the portion of the crossing member and the rear structure of the belt buckle system when the front door is in the open position.

* * * * *